US005772201A

United States Patent [19]

Shinozuka

[11] Patent Number: 5,772,201

[45] Date of Patent: Jun. 30, 1998

[54] METHOD OF AND APPARATUS FOR DAMPENING SHEETS STACKED INTO SHEET PILE

[75] Inventor: Tomoyuki Shinozuka, Shizuoka-ken, Japan

[73] Assignee: Fuji Photo Film Co., Ltd., Kanagawa, Japan

[21] Appl. No.: 636,188

[22] Filed: Apr. 22, 1996

[30] Foreign Application Priority Data

Apr. 25, 1995 [JP] Japan ..... 7-101074

[51] Int. Cl.[6] ..... B65H 31/36

[52] U.S. Cl. ..... 271/220; 271/222

[58] Field of Search ..... 271/220, 222, 271/224

[56] References Cited

U.S. PATENT DOCUMENTS

| | | | |
|---|---|---|---|
| 2,661,949 | 12/1953 | Bauer | 271/224 |
| 2,761,682 | 9/1956 | Buccicone . | |
| 2,821,391 | 1/1958 | Buccicone | 271/224 |
| 3,022,999 | 2/1962 | Mead | 271/224 |
| 3,907,128 | 9/1975 | Cathers | 271/224 |
| 4,130,206 | 12/1978 | Buccicone | 271/224 X |
| 4,525,118 | 6/1985 | Bulka et al. | 271/224 X |

FOREIGN PATENT DOCUMENTS

| | | | |
|---|---|---|---|
| 2848513 | 10/1979 | Germany . | |
| 134466 | 6/1988 | Japan | 271/224 |
| 6190 | of 1912 | United Kingdom . | |
| 485935 | 11/1936 | United Kingdom . | |
| 618602 | 5/1946 | United Kingdom . | |

*Primary Examiner*—Boris Milef

*Attorney, Agent, or Firm*—Sughrue, Mion, Zinn, Macpeak & Seas, PLLC

[57] ABSTRACT

A damping apparatus has a first damper mechanism positioned at a leading end of a sheet which is introduced into a sheet stacking region, for movement in the direction A away from the sheet stacking region to absorb shocks produced by the sheet when the sheet hits the first damper mechanism, and a second damper mechanism combined with the first damper mechanism, for movement in the direction A away from the sheet stacking region to absorb the shocks produced by the sheet S while the shocks produced by the sheet are being absorbed by the first damper mechanism and then after the first damper mechanism starts moving back in the direction B toward the sheet stacking region. Sheets can successively be introduced at a high speed into the sheet stacking region, and are effectively prevented from being folded or improperly positioned in the sheet stacking region.

10 Claims, 8 Drawing Sheets

METHOD OF AND APPARATUS FOR DAMPENING SHEETS STACKED INTO SHEET PILE

BACKGROUND OF THE INVENTION

1. Field of the Invention

The present invention relates to a method of and an apparatus for dampening sheets as they are successively deposited onto a sheet pile or stack to dampen and absorb shocks which would otherwise be imposed on the sheets.

2. Description of the Related Art

Sheet stacking machines have widely been used in the art for successively stacking or piling a plurality of sheets that are fed one by one by a sheet conveyor. Such sheet stacking machines incorporate a damper for absorbing shocks applied to the sheets in order to stack the sheets highly accurately onto a sheet pile.

FIG. 6 of the accompanying drawings shows a general damper 2 having a horizontal ball screw 6 rotatable about its own axis by a motor 4 and a vertical support plate 8 held in threaded engagement with the horizontal ball screw 6 for horizontal movement in the directions indicated by the arrows. The support plate 8 supports thereon a vertical rear stopper 10 that is horizontally movable toward and away from the support plate 8. The rear stopper 10 is normally urged to move away from the support plate 8 by a coil spring 12 acting between the support plate and the rear stopper 10. The damper 2 is incorporated in a sheet stacking machine 14 for stacking a plurality of sheets S successively fed by a sheet conveyor 16 that is positioned remote from the rear stopper 10. The damper 2 is disposed to position leading ends of the sheets S as they are successively supplied from the sheet conveyor 16 into a sheet pile in the direction indicated by the arrow A.

When each of the successive sheets S is introduced from the sheet conveyor 16 and piled into the sheet stacking machine 14, the leading end of the sheet S hits the rear stopper 10. In order to absorb the shock applied by the incoming sheet S, the rear stopper 10 is first displaced in the direction indicated by the arrow A by the sheet S, and thereafter returns in the direction indicated by the arrow B under the bias of the coil spring 12, pushing the sheet S back into a given pile position in the sheet stacking machine 14.

The sheet stacking machine 14 often processes various types of sheets S having different thicknesses and weights, and those different types of sheets S are introduced at different speeds into the sheet stacking machine 14. The mass of the rear stopper 10 and the spring constant of the coil spring 12 are usually set to match a certain type of sheets S having a great rigidity and introduced at a high speed. If less rigid sheets S are introduced into abutment against the rear stopper 10, then the rear stopper 10 is less displaced and hence is unable to sufficiently absorb the shock of the introduced sheets S because of too large repellent forces applied by the rear stopper 10. As a result, as shown in FIG. 7 of the accompanying drawings, the introduced sheet S has its abutting leading end Sa folded against the rear stopper 10 under large shock applied by the rear stopper 10.

Conversely, if the mass of the rear stopper 10 and the spring constant of the coil spring 12 are too small compared with the rigidity of the sheets S and the speed at which the sheets S are introduced, then the rear stopper 10 fails to lower the speed of travel of a sheet S after the sheet S hits the rear stopper 10. Therefore, as shown in FIG. 8A of the accompanying drawings, because of too small repellent forces applied by the rear stopper 10, when the sheet S hits the rear stopper 10, the rear stopper 10 is displaced a large distance in the direction indicated by the arrow A, and the leading end of the sheet S itself projects largely in the direction indicated by the arrow A from the position of the pile of sheets S that have already been stacked. When the rear stopper 10 subsequently springs back in the direction indicated by the arrow B as shown in FIG. 8B of the accompanying drawings, the rear stopper 10 strikes the leading end Sa of the sheet S, tending to fold the leading end Sa or position the sheet S out of registry with the already stacked sheets S.

It has been customary to adjust the mass of the rear stopper 10 and the spring constant of the coil spring 12 depending on the rigidity and speed of travel of sheets S that are handled. Even if the mass of the rear stopper 10 and the spring constant of the coil spring 12 are adjusted, however, it is impossible to prevent the sheets S from being folded at their leading ends Sa particularly when the sheets S are introduced at significantly higher speeds. For this reason, it has been the practice to introduce the sheets S into the sheet stacking machine 14 at relatively low speeds, which make the conventional sheet stacking process relatively inefficient.

SUMMARY OF THE INVENTION

It is a principal object of the present invention to provide a method of and an apparatus for dampening sheets while allowing the sheets to be introduced into a sheet pile at a relatively high speed and also effectively preventing the sheets from being folded or improperly positioned on the sheet pile.

The above and other objects, features, and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
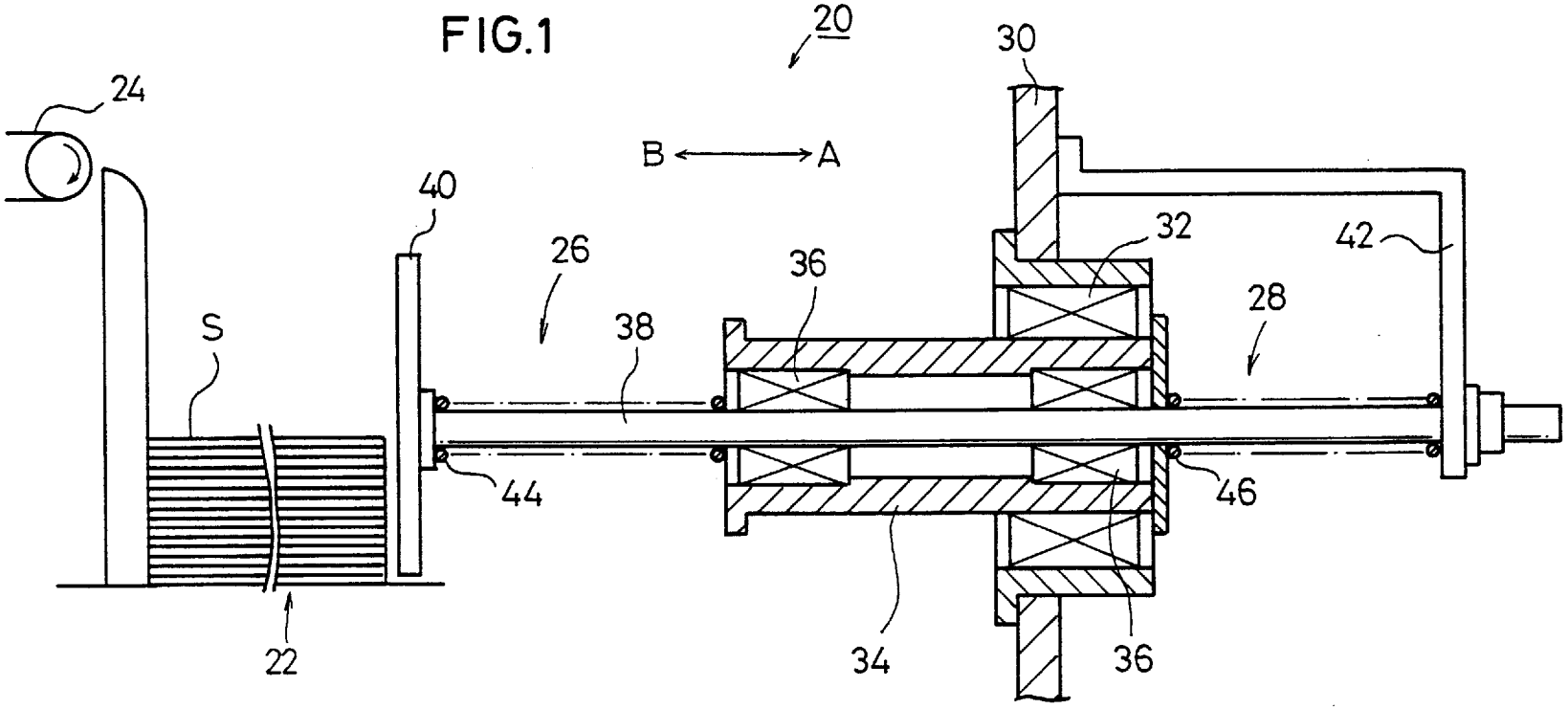
FIG. 1 is a vertical cross-sectional view of an apparatus for dampening sheets as they are successively stacked into a sheet pile, according to a first embodiment of the present invention.

As shown in FIG. 1, an apparatus 20 for dampening sheets S as they are successively stacked into a sheet pile, according to a first embodiment of the present invention, comprises a first damper mechanism 26 and a second damper mechanism 28. The first damper mechanism 26 is positioned at leading ends of sheets S successively introduced from a sheet conveyor belt 24 into a sheet stacking region 22, and is horizontally movable in the directions indicated by the arrows A, B. The second damper mechanism 28 is combined with the first damper mechanism 26, and is also movable in the directions indicated by the arrows A, B.

The second damper mechanism 26 has a horizontally movable cylinder 34. The apparatus 20 also has a vertical support plate 30 on which the movable cylinder 34 is supported by a bearing 32 for horizontal movement in the directions indicated by the arrows A, B. The movable cylinder 34 houses a pair of axially spaced bearings 36. The first damper mechanism 26 also has a horizontal rod 38 extending through and supported by the bearings 36 for horizontal movement in the directions indicated by the arrows A, B.

A vertical stopper 40 is fixed to an end of the rod 38 closely to the sheet stacking region 22. The other end of the rod 38 is slidably supported by a lower end of a guide member 42 which is fixedly attached to the support plate 30. A first coil spring 44 is disposed around the rod 38 between the vertical stopper 40 and an end of the movable cylinder 34, and a second coil spring 46 is disposed around the rod 38 between the other end of the movable cylinder 34 and the lower end of the guide member 42. The first coil spring 44 has a modulus of elasticity (spring constant) smaller than the modulus of elasticity (spring constant) of the second coil spring 46. The masses and the moduli of elasticity of the first and second coil springs 44, 46 are selected such that after a sheet S introduced from the sheet conveyor belt 24 in a direction toward the stopper 40 has hit the stopper 40, the sheet S is repelled by and moves toward the stopper 40 at a speed which is at most 50% of the speed at which the sheet S moves toward the stopper 40 before hitting the stopper 40.

Operation of the apparatus 20 will be described below in relation to a method of dampening a sheet S according to the present invention.

Figure 2A:
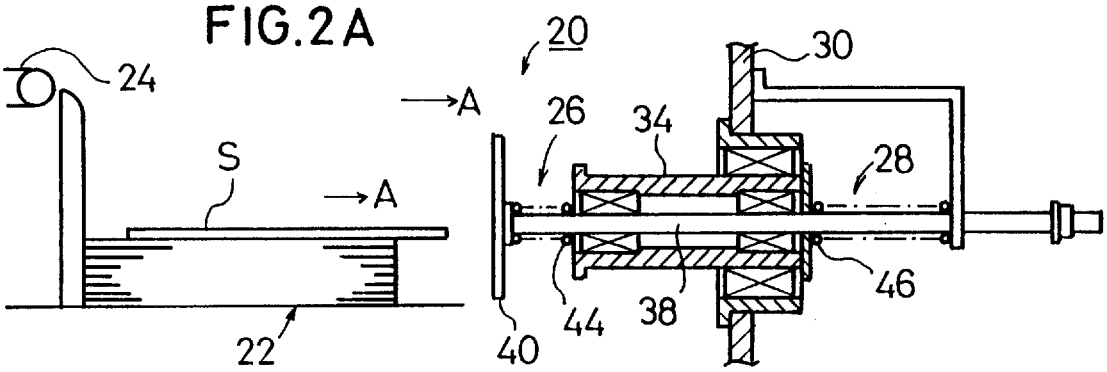
FIG. 2A is a vertical cross-sectional view showing the manner in which a stopper of the apparatus starts to dampen a sheet.

When a sheet S is introduced from the sheet conveyor belt 24 into the sheet stacking region 22 as shown in FIG. 2A, the leading end of the sheet S abuts against the stopper 40 of the first damper mechanism 26. Therefore, the stopper 40 is displaced in the direction indicated by the arrow A against the bias of the first coil spring 44, starting to dampen and absorb shocks from the sheet S introduced into the sheet stacking region 22.

Figure 2B:
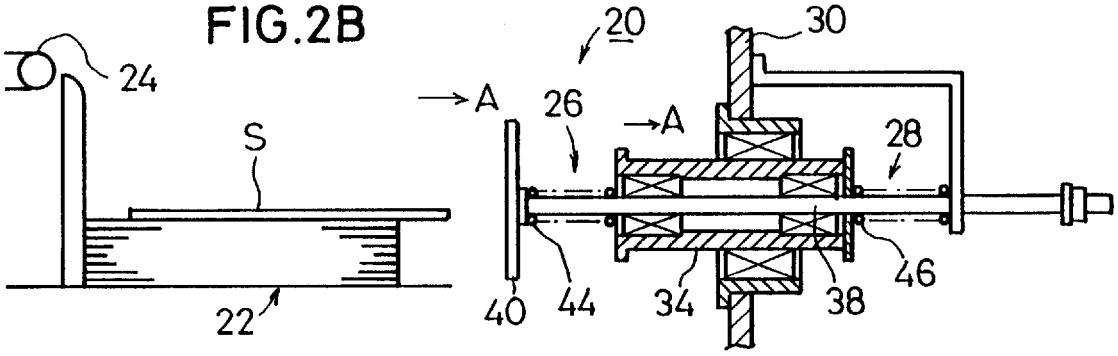
FIG. 2B is a vertical cross-sectional view showing the manner in which a movable cylinder of the apparatus starts to dampen the sheet.

When the stopper 40 is displaced in the direction indicated by the arrow A, the first coil spring 44 is forcibly compressed, and its repellent forces are increased. When the repellent forces of the first coil spring 44 exceed a predetermined value, the movable cylinder 34 of the second damper mechanism 28 starts moving in the direction indicated by the arrow A (see FIG. 2B). Specifically, the shocks from the sheet S are transmitted from the first damper mechanism 26 to the second damper mechanism 28, and when the movable cylinder 34 is displaced in the direction indicated by the arrow A against the bias of the second coil spring 46, the second damper mechanism 28 begins to dampen and absorb shocks from the sheet S.

Figure 2C:
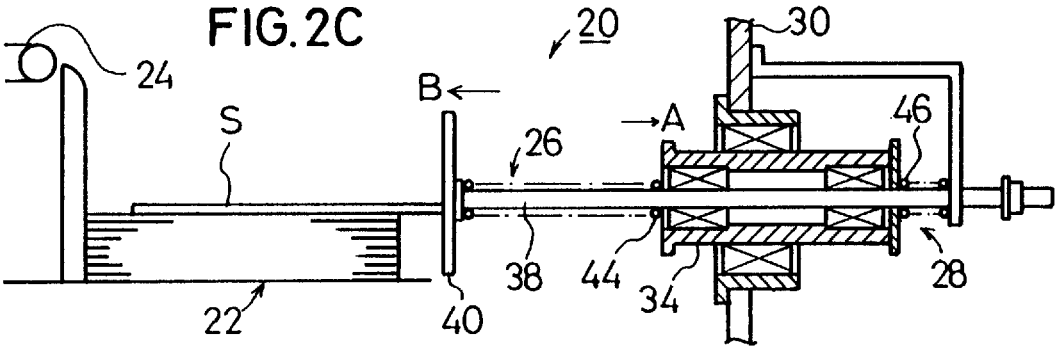
FIG. 2C is a vertical cross-sectional view showing the manner in which the stopper moves back while the movable cylinder is operating to dampen the sheet.

Then, as shown in FIG. 2C, while the movable cylinder 34 is being displaced in the direction indicated by the arrow A to dampen and absorb shocks from the sheet S, the stopper 40 finishes its movement in the direction indicated by the arrow A, and starts moving back in the direction indicated by the arrow B. When the stopper 40 is displaced back in the direction indicated by the arrow B, the movable cylinder 34 is still being displaced in the direction indicated by the arrow A. Therefore, the speed at which the stopper 40 moves back in the direction indicated by the arrow B is greatly reduced. Consequently, when the stopper 40 strikes again the leading end of the sheet S, the stopper 40 imposes very small shocks on the sheet S.

Figure 2D:
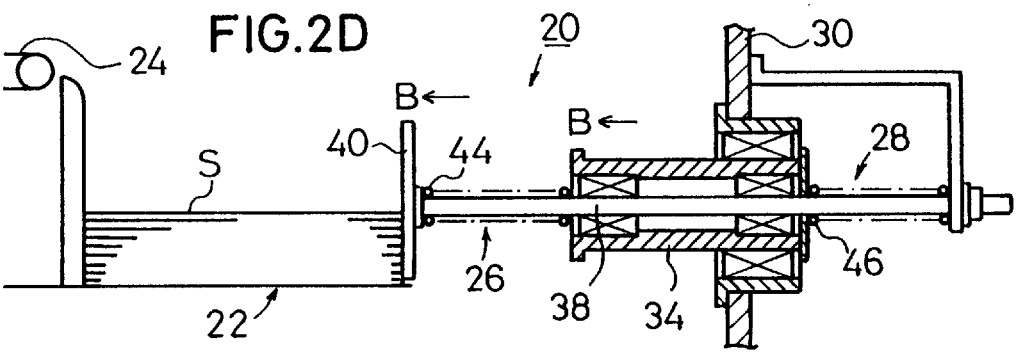
FIG. 2D is a vertical cross-sectional view showing the manner in which both the stopper and the movable cylinder move back.

After the stopper 40 strikes again the leading end of the sheet S, the stopper 40 and the movable cylinder 34 move together back in the direction indicated by the arrow B (see FIG. 2D) until they reach their original position (see FIG. 1), preparing themselves for dampening shocks from a next sheet S introduced from the sheet conveyor belt 24.

Figure 3:
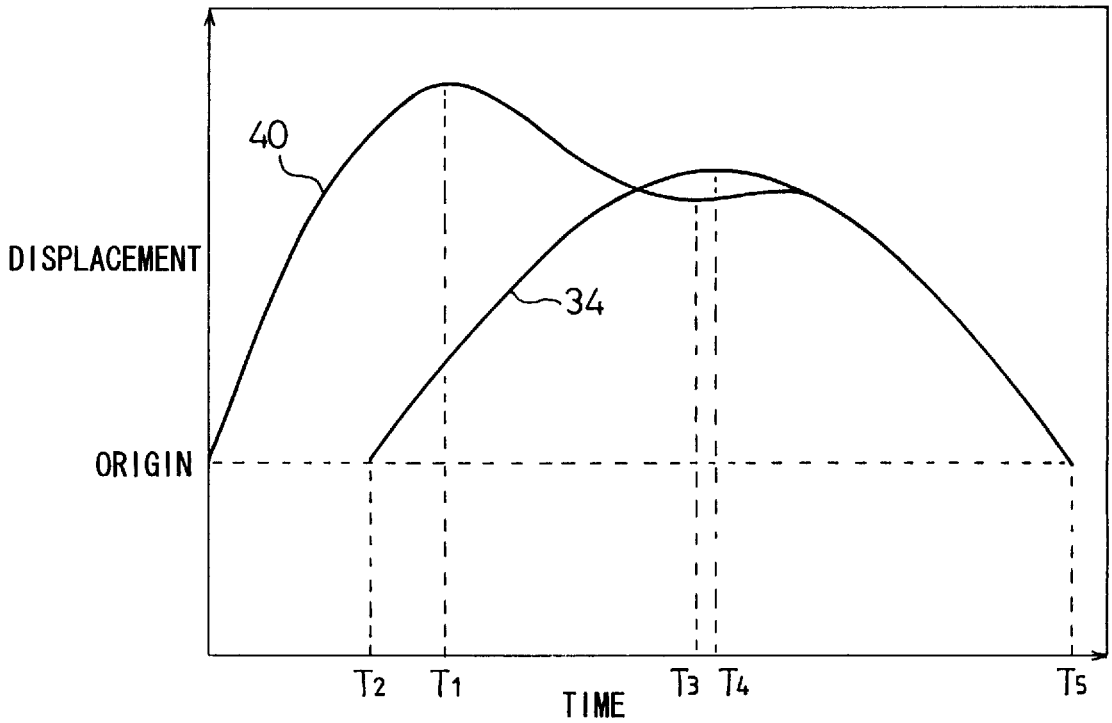
FIG. 3 is a diagram illustrative of how the stopper and the movable cylinder are displaced with time.

Time-dependent displacement of the stopper 40 and the movable cylinder 34 is shown in detail in FIG. 3. As shown in FIG. 3, when a time T1 has elapsed from the instant the sheet S hits the stopper 40, the stopper 40 reaches an end of its stroke in the direction indicated by the arrow A, and starts moving back in the direction indicated by the arrow B. The movable cylinder 34 starts moving in the direction indicated by the arrow A at a time T2, and continues to move in the direction indicated by the arrow A even after the elapse of the time T1, i.e., even after the stopper 40 starts moving back in the direction indicated by the arrow B. After the stopper 40 strikes again the sheet S at a time T3, the movable cylinder 34 begins moving back in the direction indicated by the arrow B at a time T4. After the time T4, the stopper 40 and the movable cylinder 34 move in substantial unison with each other in the direction indicated by the arrow B until they stop at a time T5.

In the first embodiment, the first and second damper mechanisms 26, 28 are combined with each other for movement with respect to each other. The first damper mechanism 26 serves to dampen and absorb shocks which are applied directly to the stopper 40 by the sheet S, followed by the second damper mechanism 28 which dampens and absorbs shocks imposed by the sheet S. Even after the stopper 40 starts moving back, as shown in FIG. 2C, the movable cylinder 34 of the second damper mechanism 28 continuously moves in the direction indicated by the arrow A, dampening and absorbing shocks imposed by the sheet S.

The stopper 40 moves back at a highly reduced speed, effectively minimizing shocks that are applied to the sheet S by the stopper 40 when it strikes again the sheet S. Therefore, even when the sheet S is introduced at a high speed from the sheet conveyor belt 24, the sheet S is effectively prevented from being folded and improperly positioned in the sheet stacking region 22.

The first damper mechanism 26 and the second damper mechanism 28 are of a highly simple structure, and hence the apparatus 20 is also of a simple structure.

As described above, the modulus of elasticity of the first coil spring 44 is smaller than the modulus of elasticity of the second coil spring 46. This is effective to suppress shocks caused when the sheet S hits the stopper 40, thereby preventing the leading end of the sheet S from moving unstably. Accordingly, the sheet S is more effectively prevented from being folded and is more effectively positioned accurately in the sheet stacking region 22.

In the first embodiment, the first and second damper mechanisms 26, 28 have the respective first and second coil springs 44, 46. However, the first and second damper mechanisms 26, 28 may have respective dampers in place of the first and second coil springs 44, 46. If such dampers are employed, then the damping coefficient of the damper associated with the stopper 40 should be smaller than the damping coefficient of the damper remote from the stopper 40.

Figure 4:
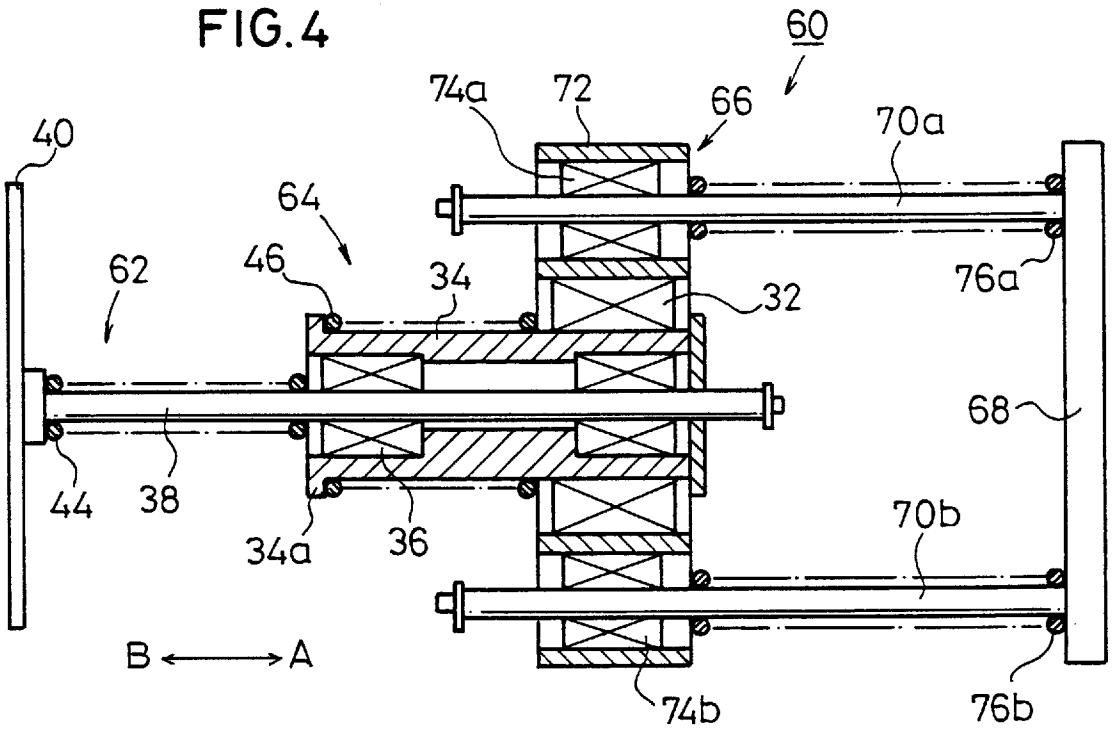
FIG. 4 is a vertical cross-sectional view of an apparatus for dampening sheets as they are successively stacked into a sheet pile, according to a second embodiment of the present invention.
Figure 5:
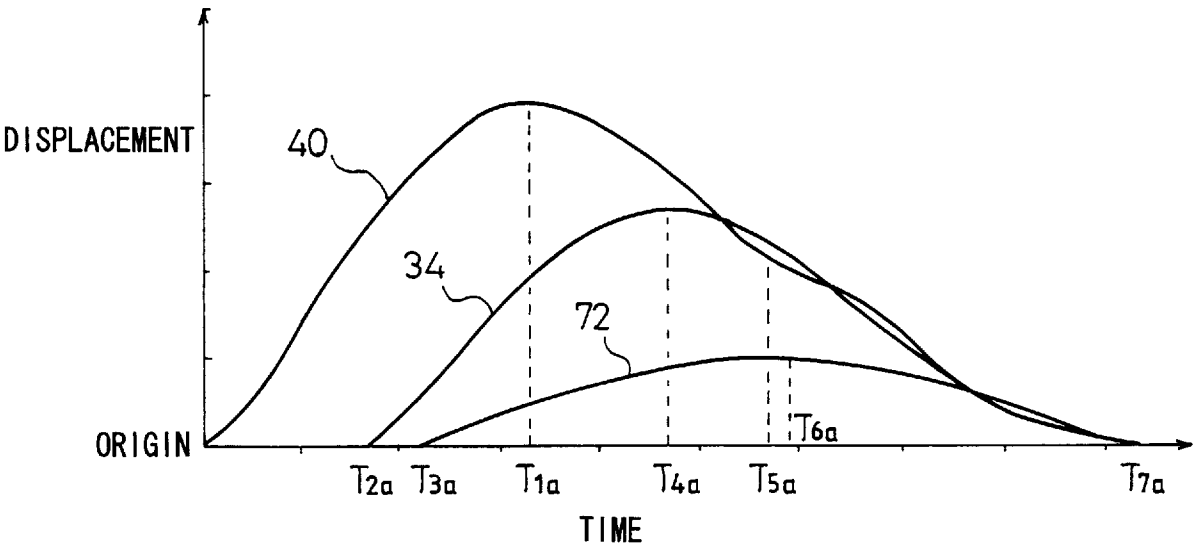
FIG. 5 is a diagram illustrative of how a stopper, a movable cylinder, and a movable body of the apparatus shown in FIG. 4 are displaced with time.
Figure 6:
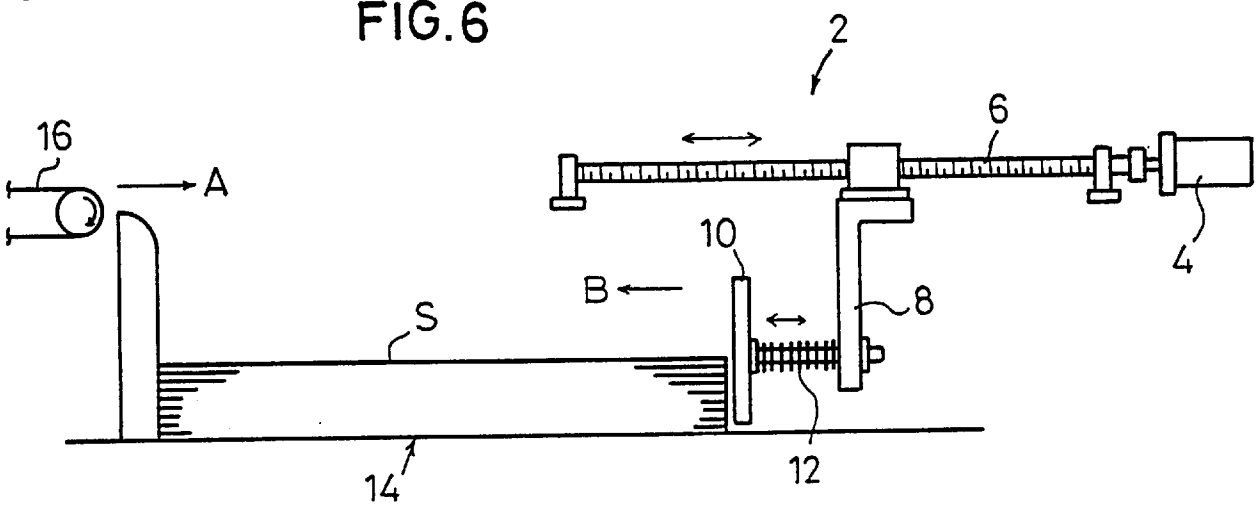
FIG.6 PRIOR ART
FIG. 6 is a side elevational view of a conventional sheet dampening apparatus.
Figure 7:
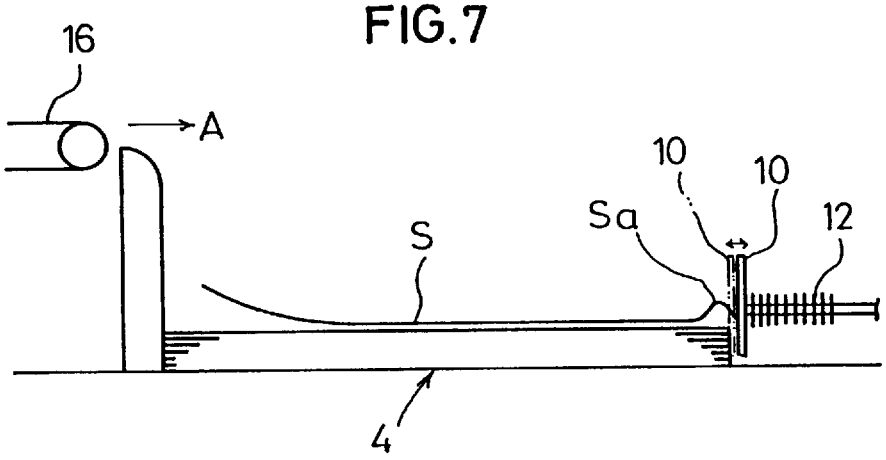
PRIOR ART FIG.7
FIG. 7 is a side elevational view of the conventional sheet dampening apparatus, showing too large repellent forces applied to a sheet by a rear stopper.
Figure 8A:
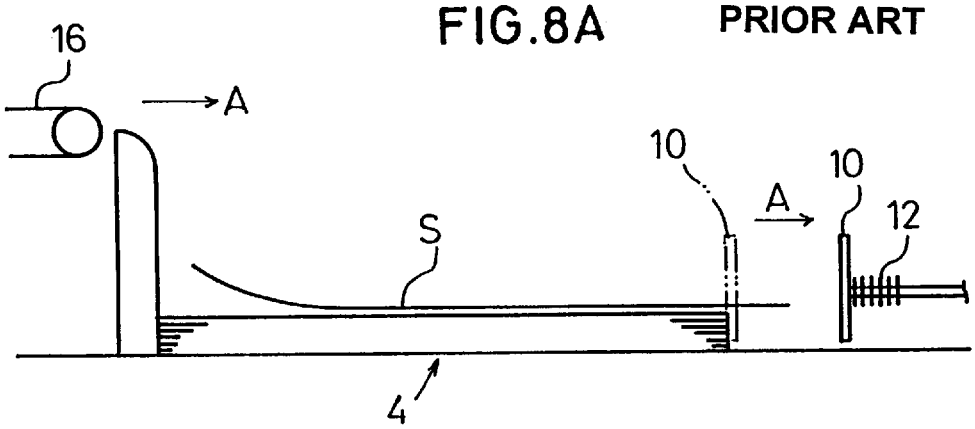
FIG.8A PRIOR ART
FIG. 8A is a side elevational view of the conventional sheet dampening apparatus, showing too small repellent forces applied to a sheet by a rear stopper.
Figure 8B:
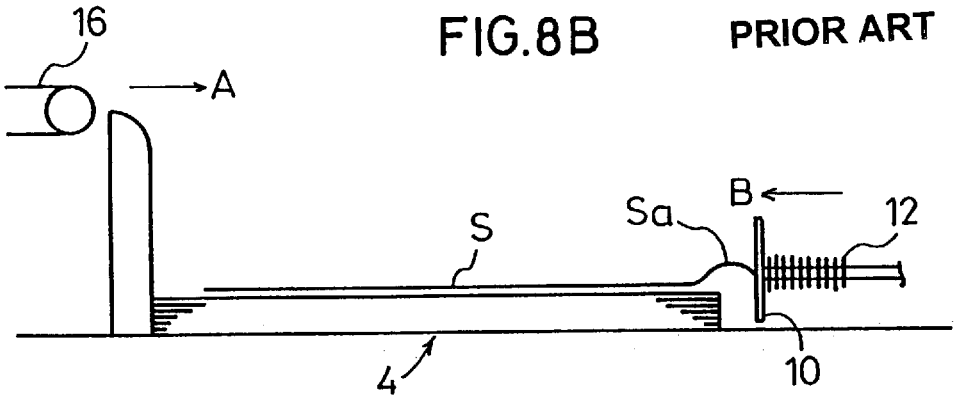
FIG.8B PRIOR ART
FIG. 8B is a side elevational view of the conventional sheet dampening apparatus, showing the rear stopper as it moves back into engagement with the sheet.

An apparatus 60 for dampening sheets S as they are successively stacked into a sheet pile, according to a second embodiment of the present invention, will be described below with reference to FIGS. 4 and 5. As shown in FIG. 4, the apparatus 60 comprises a first damper mechanism 62, a second damper mechanism 64, and a third damper mechanism 66. The first damper mechanism 62 is horizontally movable in the directions indicated by the arrows A, B. The second damper mechanism 64 is combined with the first damper mechanism 62, and is also movable in the directions indicated by the arrows A, B. The third damper mechanism 66 supports the second damper mechanism 64 and is also movable in the directions indicated by the arrows A, B. Those parts of the apparatus 60 which are identical to those of the apparatus 20 according to the first embodiment are denoted by identical reference numerals, and will not be described in detail below.

The third damper mechanism 66 comprises a pair of vertically spaced horizontal rods 70*a*, 70*b* having ends fixed to a vertical support plate 68. The third damper mechanism 66 also has a ring-shaped movable body 72 movably supported on the rods 70*a*, 70*b* by bearings 74*a*, 74*b* for movement in the directions indicated by the arrows A, B along the rods 70*a*, 70*b*. Third coil springs 76*a*, 76*b* are disposed around the rods 70*a*, 70*b*, respectively, between the movable body 72 and the support plate 68.

The second damper mechanism 64 comprises a movable cylinder 34 on which there is disposed a second coil spring 46 having opposite ends held against the movable body 72 and a larger-diameter end flange 34*a* of the movable cylinder 34, respectively. The movable cylinder 34 is movably inserted in and supported by the movable body 72.

The first damper mechanism 62 has a first coil spring 44 disposed around a rod 38 supported by the movable cylinder 34 between a stopper 40 and the movable cylinder 34.

The first coil spring 44 has a modulus of elasticity (spring constant) smaller than the modulus of elasticity (spring constant) of the second coil spring 46. The modulus of elasticity of the second coil spring 46 is smaller than the modulus of elasticity of the third coil springs 76*a*, 76*b*.

The masses and the moduli of elasticity of the coil springs 44, 46, 76*a*, 76*b* are selected such that after a sheet S introduced from the sheet conveyor belt 24 in a direction toward the stopper 40 has hit the stopper 40, the sheet S is repelled by and moves toward the stopper 40 at a speed which is at most 50% of the speed at which the sheet S moves toward the stopper 40 before hitting the stopper 40.

The apparatus 60 operates as follows: After the sheet S has hit the stopper 40, the stopper 40, the movable cylinder 34, and the movable body 72 move with time as shown in FIG. 5. In FIG. 5, upon elapse of a time T1*a* after the sheet S has hit the stopper 40, the stopper 40 reaches an end of its stroke in the direction indicated by the arrow A, and starts moving back in the direction indicated by the arrow B. The movable cylinder 34 and the movable body 72 start moving in the direction indicated by the arrow A at respective times T2*a*, T3*a*. The movable cylinder 34 and the movable body 72 continue to move in the direction indicated by the arrow A even after the time T1*a* has elapsed, i.e., when the stopper 40 starts moving back in thee direction indicated by the arrow B.

The movable cylinder 34 starts moving back in the direction indicated by the arrow B at a time T4*a*. After the stopper 40 strikes again the sheet S at a time T5*a*, the movable body 72 starts moving back in the direction indicated by the arrow B at a time T6*a*. The stopper 40, the cylinder 34, and the movable body 72 finally stop moving in the direction indicated by the arrow B at a time T7*a*.

In the second embodiment, the first, second, and second damper mechanisms 62, 64, 66 are combined with each other for movement with respect to each other. The first damper mechanism 62 serves to dampen and absorb shocks which are applied directly to the stopper 40 by the sheet S. Then, the second and third damper mechanisms 64, 66 successively dampen and absorb shocks imposed by the sheet S.

The stopper 40 moves back at a highly reduced speed, effectively minimizing shocks that are applied to the sheet S by the stopper 40 when it strikes again the sheet S. The apparatus 60 according to the second embodiment, therefore, offers the same advantages as those of the apparatus 20 according to the first embodiment.

While the apparatus 60 according to the second embodiment has the first, second, and third damper mechanisms 62, 64, 66, it may have more damper mechanisms.

The method of and the apparatus for dampening sheets as they are successively deposited onto a sheet pile or stack according to the present invention offer the following advantages:

When the leading end of a sheet introduced into a sheet stacking region hits the first damper mechanism, the first damper mechanism is displaced to dampen and absorb shocks applied by the sheet, and then the second damper mechanism and possibly at least one other damper mechanism start dampening and absorbing the shocks imposed by the sheet. The second damper mechanism continuously dampens and absorbs the shocks even after the first damper mechanism has started moving back. Therefore, the first damper mechanism moves back at a greatly reduced speed, minimizing shocks that are produced when the first damper mechanism strikes again the sheet. The sheet is thus effectively prevented from being folded when it is hit again by the first damper mechanism. Sheets can successively be introduced at higher speeds into the sheet stacking region, and hence can be stacked highly efficiently.

Although certain preferred embodiments of the present invention have been shown and described in detail, it should be understood that various changes and modifications may be made therein without departing from the scope of the appended claims.

What is claimed is:

1. A method of dampening sheets by absorbing shocks applied by the sheets which are successively introduced into a sheet stacking region and stacked in the sheet stacking region, comprising the steps of:

starting to absorb shocks produced by a sheet with a first damper mechanism which moves away from the sheet stacking region when the sheet hits the first damper mechanism;

starting to absorb the shocks produced by the sheet with a second damper mechanism which is combined with said first damper mechanism and moves away from the sheet stacking region while the shocks produced by the sheet are being absorbed by said first damper mechanism; and continuously absorbing the shocks produced by the sheet with said second damper mechanism which moves away from said sheet stacking region after said first damper mechanism starts moving back toward said sheet stacking region.

2. A method of dampening sheets by absorbing shocks applied by the sheets which are successively introduced into a sheet stacking region and stacked in the sheet stacking region, comprising the steps of:

starting to absorb shocks produced by a sheet with a first damper mechanism which moves away from the sheet stacking region when the sheet hits the first damper mechanism:

starting to absorb the shocks produced by the sheet with a second damper mechanism which is combined with said first damper mechanism and moves away from the sheet stacking region while the shocks produced by the sheet are being absorbed by said first damper mechanism;

starting to absorb the shocks produced by the sheet with a third damper mechanism which is combined with said second damper mechanism and moves away from the sheet stacking region while the shocks produced by the sheet are being absorbed by said second damper mechanism;

continuously absorbing the shocks produced by the sheet with said second damper mechanism which moves away from said sheet stacking region after said first damper mechanism starts moving back toward said sheet stacking region; and continuously absorbing the shocks produced by the sheet with said third damper mechanism which moves away from said sheet stacking region after said second damper mechanism starts moving back toward said sheet stacking region.

3. An apparatus for dampening sheets by absorbing shocks applied by the sheets which are successively introduced into a sheet stacking region and stacked in the sheet stacking region, comprising:

a first damper mechanism positioned at a leading end of a sheet which is introduced into the sheet stacking region, for absorbing shocks produced by the sheet by moving away from the sheet stacking region when the sheet hits the first damper mechanism; and a second damper mechanism combined with said first damper mechanism, for absorbing the shocks produced by the sheet by moving away from the sheet stacking region while the shocks produced by the sheet are being absorbed by said first damper mechanism and then after said first damper mechanism starts moving back toward said sheet stacking region.

4. An apparatus according to claim 3, wherein said first damper mechanism has a modulus of elasticity or a damping coefficient smaller than a modulus of elasticity or a damping coefficient of said second damper mechanism.

5. An apparatus according to claim 4, wherein masses and the moduli of elasticity or damping coefficients of the first and second damper mechanisms are selected such that after the sheet introduced into the sheet stacking region in a direction toward said first damper mechanism has hit said first damper mechanism, the sheet is repelled by and moves toward said first damper mechanism at a speed which is at most 50% of the speed at which the sheet moves toward said first damper mechanism before hitting said first damper mechanism.

6. An apparatus according to claim 3, wherein said first damper mechanism comprises a rod, a stopper mounted on an end of said rod for contacting the sheet, and a guide member supporting an opposite end of said rod, and said second damper mechanism comprises a support plate on which said guide member is fixedly mounted, and a movable member movably supported on said support plate, said rod being movably inserted in said movable member, and wherein said first damper mechanism further comprises a first coil spring disposed between said stopper and an end of said movable member, and said second damper mechanism further comprises a second coil spring disposed between said guide member and an opposite end of said movable member, said first coil spring having a modulus of elasticity smaller than a modulus of elasticity of said second coil spring.

7. An apparatus for dampening sheets by absorbing shocks applied by the sheets which are successively introduced into a sheet stacking region and stacked in the sheet stacking region, comprising:

a first damper mechanism positioned at a leading end of a sheet which is introduced into the sheet stacking region, for absorbing shocks produced by the sheet by moving away from the sheet stacking region when the sheet hits the first damper mechanism;

a second damper mechanism combined with said first damper mechanism, for absorbing the shocks produced by the sheet by moving away from the sheet stacking region while the shocks produced by the sheet are being absorbed by said first damper mechanism and then after said first damper mechanism starts moving back toward said sheet stacking region; and a third damper mechanism combined with said second damper mechanism, for absorbing the shocks produced by the sheet by moving away from the sheet stacking region while the shocks produced by the sheet are being absorbed by said second damper mechanism and then after said second damper mechanism starts moving back toward said sheet stacking region.

8. An apparatus according to claim 7, wherein said first damper mechanism has a modulus of elasticity or a damping coefficient smaller than a modulus of elasticity or a damping coefficient of said second damper mechanism, and the modulus of elasticity or the damping coefficient of said second damper mechanism is smaller than a modulus of elasticity or a damping coefficient of said third damper mechanism.

9. An apparatus according to claim 8, wherein masses and the moduli of elasticity or damping coefficients of the first, second, third damper mechanisms are selected such that after the sheet introduced into the sheet stacking region in a direction toward said first damper mechanism has hit said first damper mechanism, the sheet is repelled by and moves toward said first damper mechanism at a speed which is at most 50% of the speed at which the sheet moves toward said first damper mechanism before hitting said first damper mechanism.

10. An apparatus according to claim 7, wherein said first damper mechanism comprises a rod and a stopper mounted on an end of said rod for being engageable by the sheet, said second damper mechanism comprises a movable member, said rod being movably inserted in said movable member, said third damper mechanism comprises a support plate, support rods fixed to said support plate, and a movable member movably supported on said support rods, said movable member being movably supported by said movable body, and wherein said first damper mechanism further comprises a first coil spring disposed between said stopper and an end of said movable member, said second damper mechanism further comprises a second coil spring disposed between said movable member and an end of said movable body, said first coil spring having a modulus of elasticity smaller than a modulus of elasticity of said second coil spring, and said third damper mechanism further comprises third coil spring disposed between an opposite end of said movable body and said support plate, said modulus of elasticity of said second coil spring being smaller than a modulus of elasticity of said third coil spring.

* * * * *